US006247829B1

(12) United States Patent
Lee

(10) Patent No.: US 6,247,829 B1
(45) Date of Patent: Jun. 19, 2001

(54) INTERCHANGEABLE LAMP APPARATUS HAVING A DETACHABLE PLUG

(75) Inventor: Steve Lee, Chicago, IL (US)

(73) Assignee: LumiSource, Inc., Elk Grove Village, IL (US)

( * ) Notice: Subject to any disclaimer, the term of this patent is extended or adjusted under 35 U.S.C. 154(b) by 0 days.

(21) Appl. No.: 09/478,157

(22) Filed: Jan. 5, 2000

(51) Int. Cl.[7] ..... H01R 33/00

(52) U.S. Cl. ..... 362/226; 362/95; 362/216; 439/217; 439/218; 439/537

(58) Field of Search ..... 362/226, 216, 362/95; 439/217, 218, 220, 221, 537

(56) References Cited

U.S. PATENT DOCUMENTS 1,595,973 * 9/1926 Hudson et al. ..... 362/95

4,952,157 * 8/1990 Hudson et al. ..... 439/92

* cited by examiner

*Primary Examiner*—Sandra O'Shea
*Assistant Examiner*—Bertrand Zeade
(74) *Attorney, Agent, or Firm*—Pauley Petersen Kinne & Fejer

(57) ABSTRACT

An interchangeable lamp apparatus having a detachable plug which is positionable in one of a plurality of orientations with respect to a base of the lamp apparatus. A construction of the base protects against undesired electrical shock when the plug is detached from the base whereby current can flow through the base and the lamp apparatus only when there is continuity across first contacts.

15 Claims, 6 Drawing Sheets

INTERCHANGEABLE LAMP APPARATUS HAVING A DETACHABLE PLUG

BACKGROUND OF THE INVENTION

1. Field of the Invention

This invention relates to an interchangeable lamp apparatus having a detachable plug which is positionable in one of a plurality of orientations with respect to a base of the lamp apparatus and a construction of the base protects against undesired electrical shock when the plug is detached from the base.

2. Description of Related Art

Conventional lamps have a base or stand and a bulb which is insertable into a socket disposed within the base or stand. While these conventional lamps may provide adequate light, they also have several disadvantages.

One disadvantage of conventional lamps is that if the base is connected to a power supply with the bulb detached from the base, there is a substantial risk of electrical shock, for example, if a person places his or her finger or another conductive object in an open socket of the base.

Another disadvantage of conventional lamps is that an attached bulb is limited to one orientation or position with respect to a base. Conventional light bulbs are inserted into the base and rotated to a position where a conductor of the bulb contacts the socket within the base.

It is apparent that there is a need for a lamp apparatus having a base with interchangeable decorative bulbs of different size, shape and/or color. It is also apparent that there is a need for a lamp apparatus having a base design that minimizes the risk of electrical shock when the plug is in a detached position. Further, it is apparent that there is a need for a lamp apparatus wherein the plug is positionable in a plurality of orientations with respect to the base of the lamp apparatus, so that the decorative bulb and the base can be arranged in different aesthetic combinations.

SUMMARY OF THE INVENTION

It is one object of this invention to provide a lamp apparatus that has a detachable plug, allowing interchangeabilty of other plugs, each with a bulb having a different size, shape, configuration and/or color.

It is another object of this invention to provide a lamp apparatus having a base designed to minimize the risk of electrical shock when the plug is in a detached position.

It is still another object of this invention to provide a lamp apparatus having a plug that is positionable in a plurality of orientations with respect to the base of the lamp apparatus.

The above and other objects of this invention are accomplished with a lamp apparatus having a base with a bore. The bore is defined by a support wall molded into, integrated with or otherwise attached to the base. Preferably, the support wall is a segmented wall formed by at least two arcuate segmented wall portions.

At least two first contacts are connected to the base and spaced apart from each of the other first contacts. For example, the first contacts can be separated from each other by the segmented wall portions. The first contacts are recessed, such as in a radially outward direction, from the support wall defining the bore and away from the bore. Preferably, but not necessarily, the first contacts are spring-loaded or biased radially inward, toward the bore. Each first contact is electrically connected to a power supply.

A second contact, for example an electrode, is mounted with respect to the base and is exposed to the bore. The second contact is spaced apart from each of the first contacts. The second contact is electrically connected to the power supply.

Electric current can flow through the base and the lamp apparatus only when there is continuity across the first contacts and the second contact. As a result of the spacing of each first contact with respect to the other first contacts and the second contact, an electric system is closed only when there is simultaneous contact across each of the first contacts and the second contact. This safety feature minimizes the risk of electrical shock if, for example, a person places his or her finger or another conductive object into the bore while the base is connected to the power supply. This safety feature is enhanced when the first contacts are recessed from the support wall and away from the bore.

The lamp apparatus has a detachable plug, mateable with the bore. A first conductor and a second conductor are connected with respect to the plug. In one preferred embodiment of this invention, the first conductor is a conductor ring having at least two projections which extend radially outward from a periphery of the conductor ring.

The bulb is an electrical ornamental or decorative bulb wherein a voltage is applied across one or more inert gases within the bulb to create a plurality of traveling electrical arcs in one or more colors. In such an embodiment, the bulb may be non-symmetrical. The bulb may be made of a transparent or translucent glass having any size, shape, configuration, symmetry and/or color.

When the detachable plug is inserted into the bore, the projections of the conductor ring are positioned within projection entry slots radially offset with respect to a corresponding first contact and molded into, integrated with or otherwise attached to the support wall.

In one preferred embodiment of this invention, after each projection is positioned within a corresponding projection entry slot, the plug is rotatable to a locked position wherein each first contact contacts a corresponding projection and the second contact contacts the second conductor of the plug.

The plurality of projections of the conductor ring and the plurality of first contacts allow for the positioning of the plug in a plurality of orientations with respect to the base. The plug is detachable and replaceable with a second similar plug having a different bulb.

The lamp apparatus has an electric system capable of detecting small gas leaks from the bulb. As inert gas leaks from the bulb, an electric surge or spike results from the increased electric demand to produce electrical arcs within the bulb. The electric surge opens the electric system and the electric system cannot close for a delay period.

BRIEF DESCRIPTION OF THE DRAWINGS

The drawings show different features of a lamp apparatus, according to preferred embodiments of this invention, wherein.

DETAILED DESCRIPTION OF THE PREFERRED EMBODIMENTS

Figure 1:
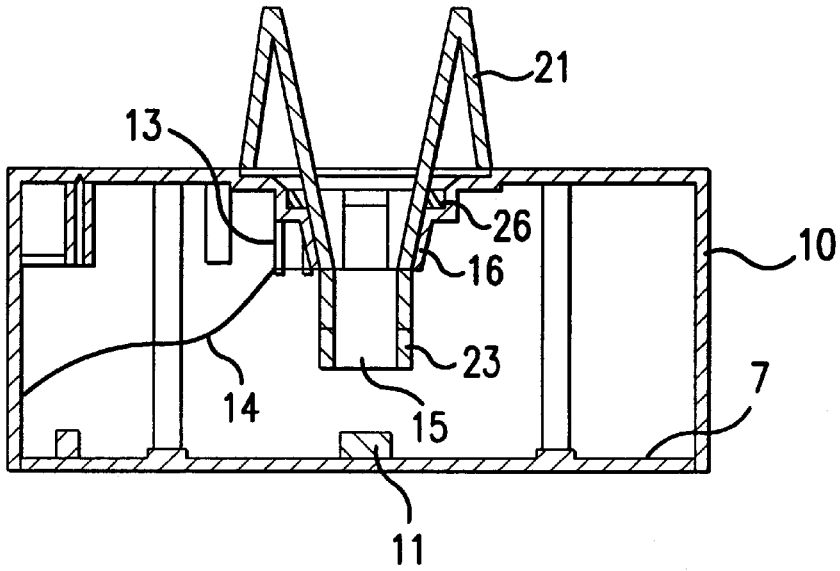
FIG. 1 is a cross-sectional side view of the base of the lamp apparatus, according to one preferred embodiment of this invention.
Figure 2:
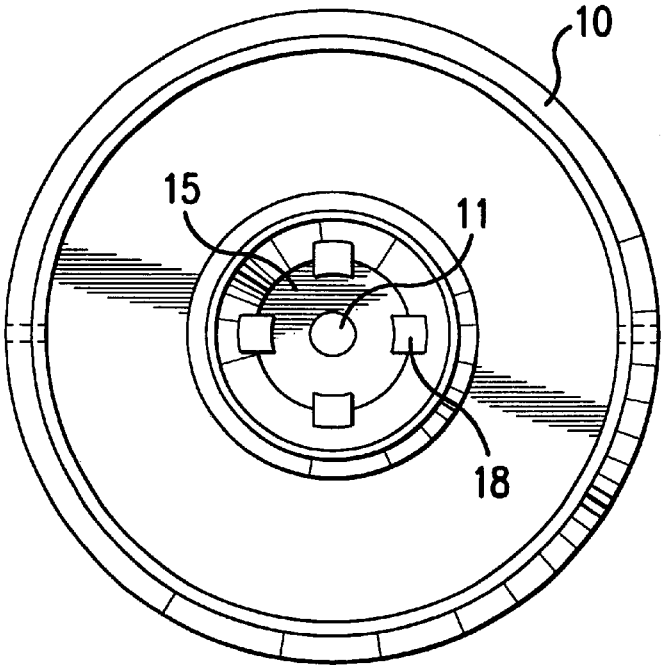
FIG. 2 is top view of the base of the lamp apparatus, according to one preferred embodiment of this invention.
Figure 3:
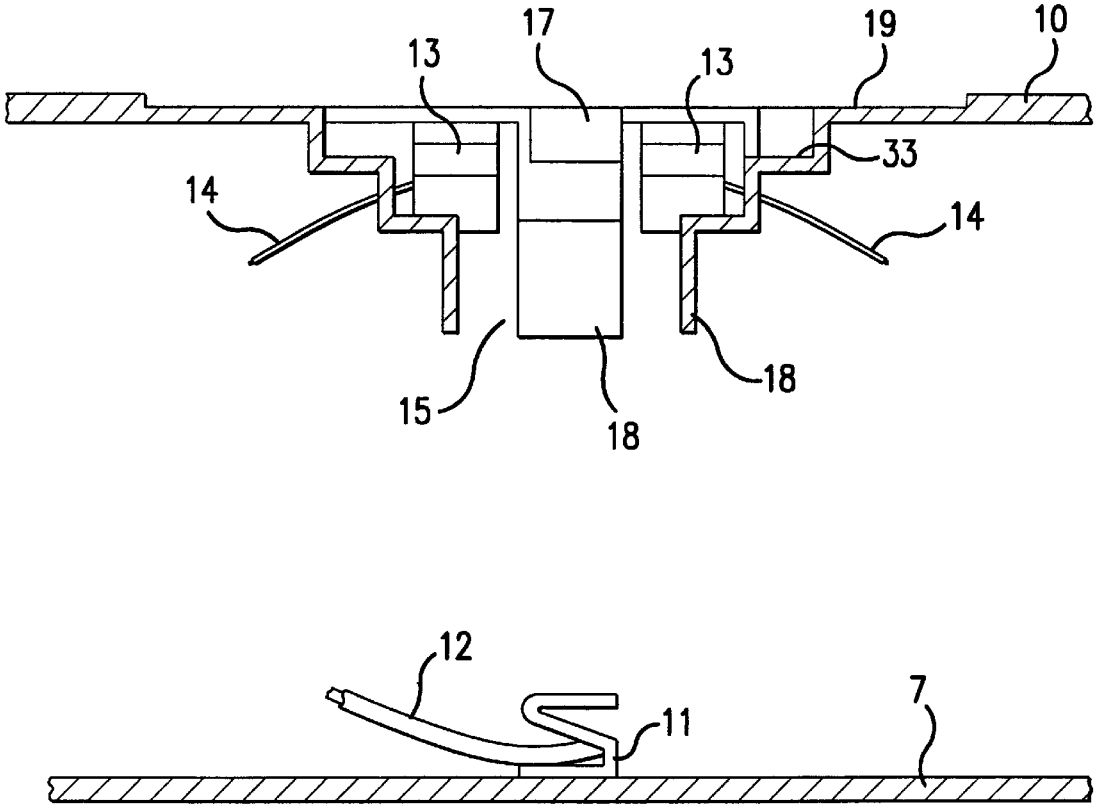
FIG. 3 is an enlarged partial cross-sectional side view of the base of the lamp apparatus, according to one preferred embodiment of this invention.

A lamp apparatus 5 according to a preferred embodiment of this invention comprises a base 10 having a bore 15. Bore 15 is defined by a support wall 16. Preferably but not necessarily, support wall 16 is molded into, integrated with or otherwise attached to base 10 by means well known to those skilled in the art. Preferably, support wall 16 is a segmented wall formed by at least two segmented wall portions 18, as shown in FIG. 3. In one preferred embodiment of this invention, support wall 16 is formed by four arcuate segmented wall portions 18 equally spaced apart from each other to define bore 15 having a generally circular shape, as shown in FIGS. 2 and 3. It is apparent to those skilled in the art that support wall 16 may comprise a continuous wall or may be formed by a plurality of segmented wall portions 18 or tabs defining bore 15 having any general geometric shape, for example a rectangle or triangle.

As shown in FIG. 3, at least two first contacts 13 are connected to base 10. First contacts 13 are made of any suitable conductive material known to those skilled in the art. It is apparent to one skilled in the art that any number of first contacts 13 may be used, for example, three, four or five first contacts 13, without departing from the basic principles of this invention. In one preferred embodiment of this invention, each first contact 13 is spaced apart from each of the other first contacts 13. First contacts 13 are separated from each other by segmented wall portions 18, as shown in FIG. 3. In another preferred embodiment of this invention, first contacts 13 are equally spaced about support wall 16 defining bore 15. First contacts 13 are recessed, such as in a radially outward direction, from support wall 16 defining bore 15 and away from bore 15. Preferably, but not necessarily, first contacts 13 are spring-loaded or biased radially inward toward bore 15. A first power lead 14 electrically connects each first contact 13 to a power supply (not shown). Preferably, the power supply provides a 12 V dc current to lamp apparatus 5. Any power supply known to those skilled in the art may be used to provide sufficient power to operate lamp apparatus 5.

A second contact 11, for example an electrode, is mounted with respect to base 10 and is exposed to bore 15. Preferably, but not necessarily, second contact 11 is mounted on an inner surface of a bottom plate 7 of base 10 and aligned with bore 15, as shown in FIG. 3. Second contact 11 is spaced apart from each first contact 13. Second contact 11 is electrically connected to the power supply (not shown) via a second power lead 12.

Figure 7:
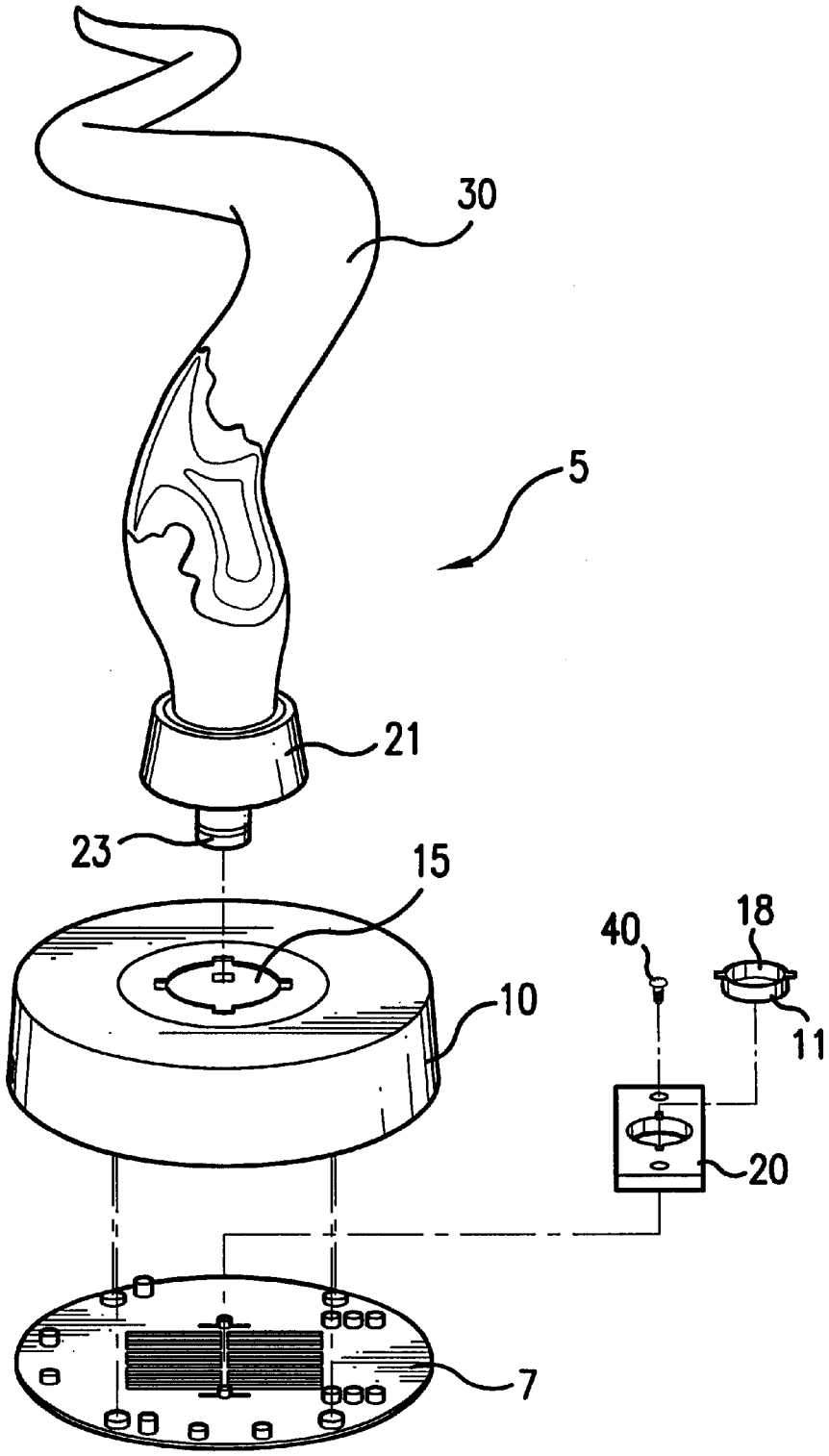
FIG. 7 is a side view of the base of the lamp apparatus in connection with one embodiment of the bulb according to one preferred embodiment of this invention.

In one preferred embodiment of this invention, as shown in FIG. 7, second contact 11 has a generally circular periphery and an inner surface 18. It is apparent to those skilled in the art that second contact 11 may have any periphery, for example, a rectangular or triangular periphery. Second contact 11 is mounted with respect to bottom plate 7 of base 10 and aligned with bore 15. Preferably, but not necessarily, second contact 11 is mounted to a plate 20, which is connected to bottom plate 7 by a fastening means, for example a screw 40. Any fastening means known to those having ordinary skill in the art may be used to fasten plate 20 to bottom plate 7.

Electric current can flow through an electrical system of lamp apparatus 5 only when there is continuity across each first contact 13 and second contact 11. As a result of the spacing of each first contact 13 with respect to other first contacts 13 and second contact 11, the electric system is closed only when there is simultaneous contact across each first contact 13 and second contact 11. This safety feature minimizes the risk of electrical shock if, for example, a person places his or her finger or another conductive object into bore 15 while base 10 is connected to the power supply. This safety feature is enhanced when first contacts 13 are recessed from support wall 16 and away from bore 15.

Figure 5:
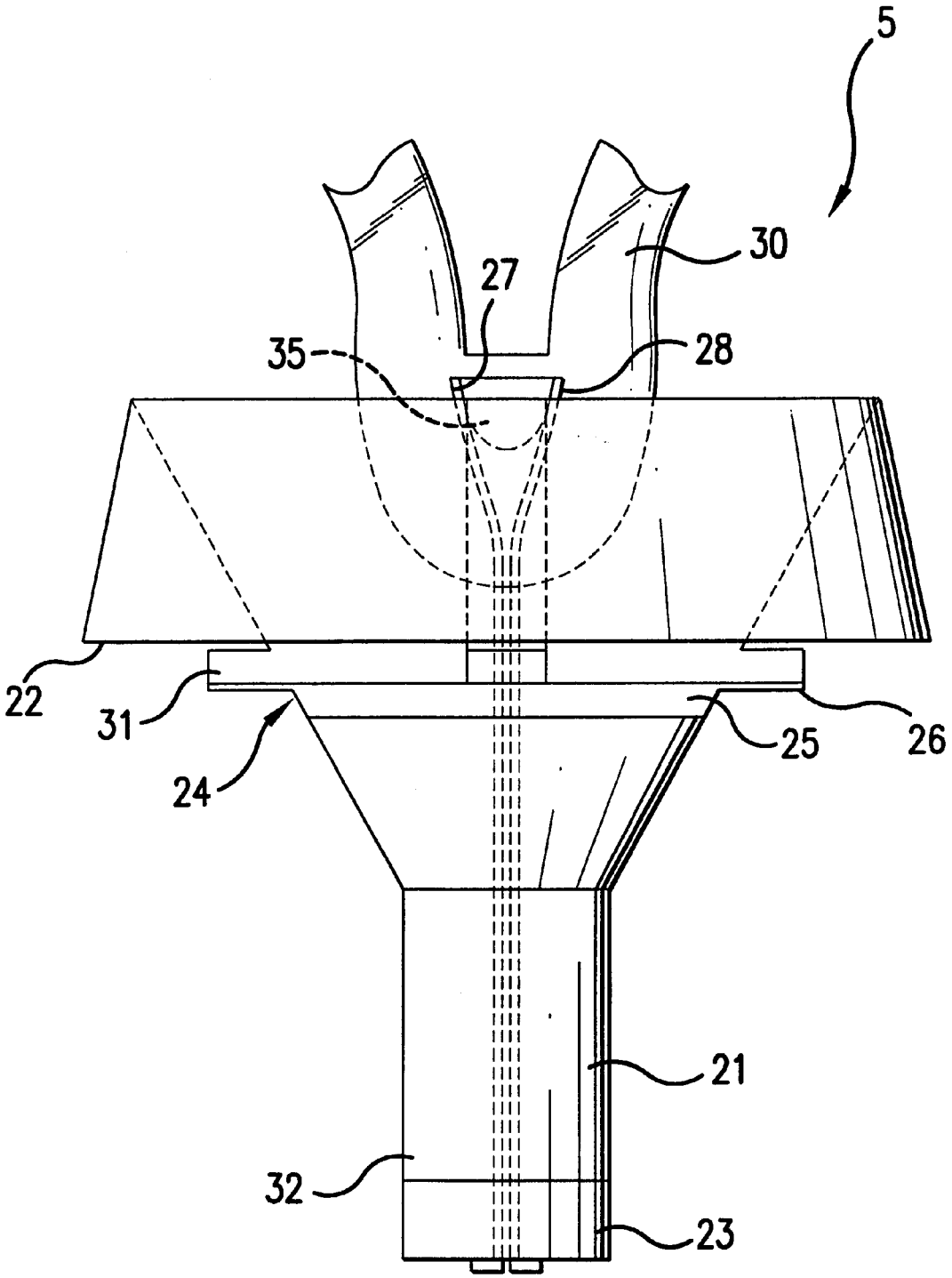
FIG. 5 is a schematic view of the plug of the lamp apparatus, according to one preferred embodiment of this invention.

As shown in FIG. 5, lamp apparatus 5 further comprises a detachable plug 21, having a support surface 22, mateable with bore 15. Plug 21 further comprises a bulb 30. A first conductor 24 is connected with respect to plug 21. Preferably, first conductor 24 is mounted to a first end portion 31 of plug 21. First conductor 24 is made of any suitable conductive material known to those skilled in the art.

Figure 4:
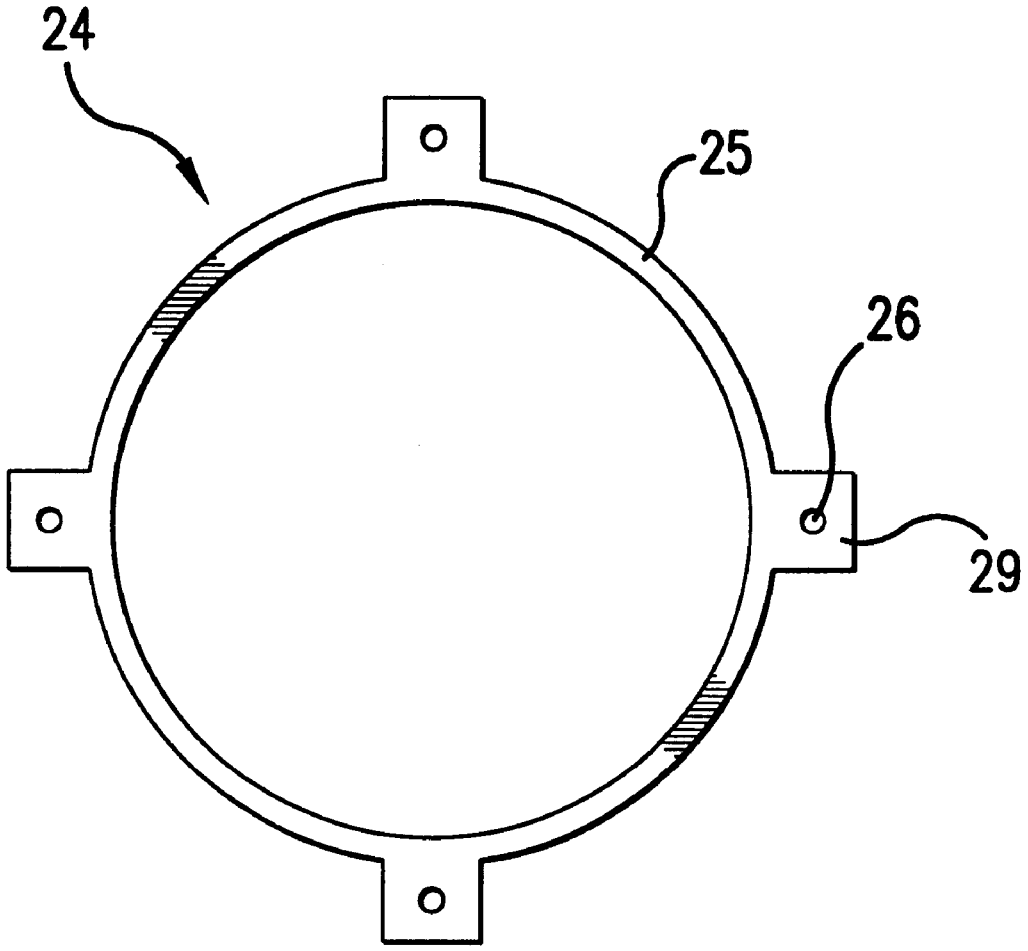
FIG. 4 is a schematic view of the conductor ring, according to one preferred embodiment of this invention.

In one preferred embodiment of this invention, first conductor 24 comprises a conductor ring 25, as shown in FIGS. 4 and 5. Preferably, but not necessarily, conductor ring 25 has a generally circular periphery. It is apparent to those skilled in the art that conductor ring 25 may have any periphery, for example, a rectangular or triangular periphery.

Figure 6:
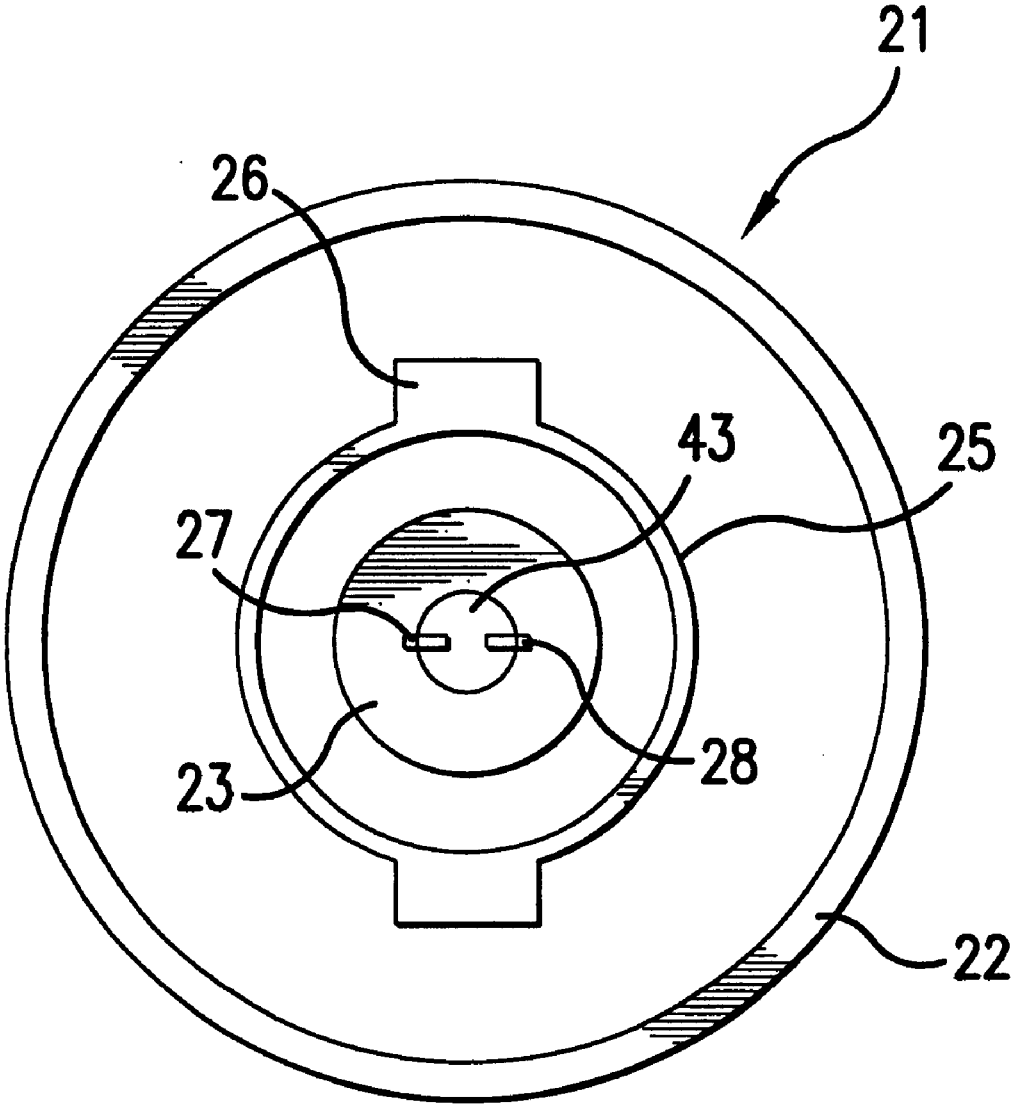
FIG. 6 is a bottom view of the plug of the lamp apparatus according to one preferred embodiment of this invention.

Conductor ring 25 comprises at least two projections 26, which extend from the periphery of conductor ring 25. Conductor ring 25 may comprise any number of projections 26, for example three, four or five projections, without departing from the basic principles of this invention. In one preferred embodiment of this invention, projections 26 are equally spaced around the periphery of conductor ring 25, as shown in FIGS. 4 and 6.

As shown in FIG. 4, preferably but not necessarily, each projection 26 forms at least one aperture 29. Aperture 29 may have any suitable shape and/or dimensions. During the manufacture process of plug 21, material forming plug 21 flows through aperture 29 to securely connect conductor ring 25 with plug 21.

A second conductor 23 is connected with respect to plug 21. Preferably, second conductor 23 is mounted to a second end portion 32 of plug 21, as shown in FIG. 5. Second conductor 23 is made of any suitable conductive material known to those skilled in the art. A first wire 27 and a second wire 28 are connected to second conductor 23. First wire 27 and second wire 28 extend through a cavity 43 of plug 21 and emerge from cavity 43 of plug 21 within bulb 30. In one preferred embodiment of this invention, an electrode 35 is connected with respect to first wire 27 and second wire 28, as shown in FIG. 5.

In one preferred embodiment of this invention, bulb 30 is an electrical ornamental or decorative bulb wherein a voltage is applied across one or more inert gases within bulb 30 to create a plurality of traveling, ethereal electrical arcs in one or more colors. In such an embodiment, bulb 30 may be non-symmetrical. Bulb 30 is preferably made of a translucent glass. Any suitable material known to those skilled in the art may be used to produce bulb 30, being transparent or translucent, of any size, shape, configuration, symmetry and/or color.

Lamp apparatus 5 according to this invention enables multiple configurations of bulbs 30, specifically decorative electrical arcing bulbs to be interchangeable with one another. For example, the horn-shaped bulb shown in FIG. 7 may be exchanged with a mushroom-shaped bulb or a spherical bulb.

Lamp apparatus 5 according to a preferred embodiment of this invention is capable of detecting small gas leaks from bulb 30. The leakage of inert gas from bulb 30 results in a higher demand for electricity to produce the electrical arcs within bulb 30. The higher demand for electricity produces an electric surge or spike which automatically opens the electric system of lamp apparatus 5. Once the electric system is open, there is a time delay, preferably about 3 seconds, before the electric system can be closed to operate lamp apparatus 5. For example, if bulb 30 breaks and exposes electrode 35, connected to first wire 27 and second wire 28, to atmosphere, the electric system opens to minimize the risk of electrical shock.

When plug 21 is mated with or inserted into bore 15, projections 26 engage with base 10 and support surface 22 of plug 21 contacts a recessed surface 19 of base 10. Support surface 22 provides a stable mounting surface when plug 21 is in the inserted position. In the inserted position, projections 26 of conducting ring 25 are positioned within projection entry slots or entry slots 17, as shown in FIG. 3. Each projection entry slot 17 is preferably radially offset with respect to a corresponding first contact 13 and molded into, integrated with or otherwise attached to support wall 16 to form a support surface 33, which each corresponding projection 26 contacts.

In one preferred embodiment of this invention, after each projection 26 is positioned within a corresponding projection entry slot 17, plug 21 is rotatable to a locked position wherein each first contact 13 contacts a corresponding projection 26 of conducting ring 25 and second contact 11 contacts second conductor 23 of plug 21.

In one preferred embodiment as shown in FIG. 7, second conductor 23 is mateable with second contact 11. Second conductor 23 contacts inner surface 18 of second contact 11 when plug 21 is in the inserted position.

The plurality of projections 26 of conductor ring 25 and the plurality of projection entry slots 17 and corresponding first contacts 13, allow plug 21, having a non-symmetrical bulb 30, to be positioned in a plurality of orientations with respect to base 10 so that decorative bulb 30 and the base 10 can be arranged in different aesthetic combinations. Plug 21 is detachable and replaceable with a second similar plug 21 having a different bulb 30.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed:

1. A lamp apparatus comprising:

a base having a bore, a plug mateable within the bore;

two first contacts connected to the base and spaced apart from each other, a second contact mounted with respect to the base, each of the two first contacts spaced apart from the second contact;

a first conductor mounted with respect to the plug, the first conductor contacting each of the two first contacts when the plug is in an inserted position within the bore;

a second conductor mounted with respect to the plug and spaced apart from the first conductor, the second conductor contacting the second contact when in the inserted position;

a first power lead connected to each of the two first contacts; and a second power lead connected to the second contact.

2. The lamp apparatus of claim 1 further comprising a power supply electrically connected to each of the two first contacts and the second contact.

3. The lamp apparatus of claim 1 wherein each of the two first contacts is recessed from a support wall defining the bore and away from the bore.

4. The lamp apparatus of claim 1 wherein each of the two first contacts are biased toward the bore.

5. The lamp apparatus of claim 1 wherein the first conductor comprises a conductor ring contacting each of the two first contacts in the inserted position.

6. The lamp apparatus of claim 5 wherein the conductor ring has two projections, one projection of the projections contacting one first contact of the first contacts in the inserted position and an other projection of the projections contacting an other first contact of the first contacts in the inserted position.

7. The lamp apparatus of claim 6 wherein the projections are equally spaced around a periphery of the conductor ring.

8. The lamp apparatus of claim 1 wherein the base comprises two projection entry slots radially offset with respect to the two first contacts, one projection entry slot of the projection entry slots radially offset with respect to one first contact of the first contacts and an other projection entry slot of the projection entry slots radially offset with respect to an other first contact of the first contacts.

9. The lamp apparatus of claim 1 wherein two or more decorative, electrical arcing bulbs are interchangeable within the base.

10. In a lamp apparatus having a base and a bulb, the improvement comprising:

said base having a bore;

said bulb having a detachable plug mateable within said bore;

said base having two entry slots radially offset with respect to two first contacts, one slot of said entry slots radially offset with respect to one first contact of said first contacts and an other slot of said entry slots radially offset with respect to an other first contact of said first contacts; and two projections mounted with respect to said detachable plug, said projections insertable into said entry slots, with said detachable plug in an inserted position within said bore said projections engaged with said base.

11. The lamp apparatus of claim 10 further comprising a power supply electrically connected to each of said first contacts and said second contact.

12. The lamp apparatus of claim 10 wherein said first contacts are biased toward said bore.

13. The lamp apparatus of claim 10 wherein each of said first contacts are recessed from a support wall defining said bore and away from said bore.

14. The lamp apparatus of claim 10 wherein said projections are equally spaced around a periphery of said conductor ring.

15. The lamp apparatus of claim 10 wherein a second bulb is interchangeable with the bulb, the second bulb containing inert gases that create ethereal electrical arcing within the second bulb.

* * * * *